United States Patent [19]

Newsome

[11] Patent Number: 4,463,942

[45] Date of Patent: Aug. 7, 1984

[54] HOLLOW NEEDLE FOR CARD SEPARATION

[76] Inventor: John R. Newsome, R.R. #1, Box 58A, Shumway, Ill. 62461

[21] Appl. No.: 407,510

[22] Filed: Aug. 12, 1982

[51] Int. Cl.[3] ..... B65H 3/14

[52] U.S. Cl. ..... 271/12; 271/98; 271/102; 271/105

[58] Field of Search ..... 271/12, 11, 98, 99, 271/100, 102, 105

[56] References Cited

U.S. PATENT DOCUMENTS

| | | | |
|---|---|---|---|
| 2,849,232 | 8/1958 | Halahan | 271/98 |
| 3,655,181 | 4/1972 | Paulson | 271/98 |

*Primary Examiner*—Richard A. Schacher

*Attorney, Agent, or Firm*—Leydig, Voit, Osann, Mayer & Holt, Ltd.

[57] ABSTRACT

A machine for feeding cards one by one from a vertical stack including a platform for supporting the trailing edge of the stack and a stripper type support for the leading edge corner portion of the stack in the form of a needle having a downwardly angled tip portion extending inwardly under the corner of the stack so that the leading edge of the bottom card rests against the tip portion of the needle. A suction cup is mounted for vertical movement between an upper position in which the cup is in engagement with the bottom card of the stack adjacent the needle and a downwardly retracted position which is below the tip portion of the needle so that the leading edge of the bottom card flicks past the tip of the needle as the card is drawn downwardly. The needle is of hollow construction having a source of pressurized air and the tip of the needle has a longitudinally extending discharge orifice which faces upwardly and which extends both above and below the corner of the stack dividing the orifice into an upper portion and a lower portion. The source of air is at a sufficiently high pressure so that the air from the upper portion of the orifice is forced between the lowermost cards in the region above the suction cup thereby breaking any suction which may exist between the cards and serving as a lubricant for the bottom card facilitating its prompt release from the stack.

8 Claims, 13 Drawing Figures

4
3
165
71
55
56
53
54
59
59
164
162
51
52
57
58
47
48
45
80
43
44
163
46
41
40
42
15
23
24
90
100
21
22
91
91
140
4
3

165
56
54
52
74
59
58
71
48
12
S
72
73
11
10
44
70
122
42
15
131
105
125
28
141
121
20
15'
143
27
144
24
140
22

HOLLOW NEEDLE FOR CARD SEPARATION

It is a common practice to insert cards, generally postcards, in a magazine at the time that the magazine is bound, the cards being either bound in or loosely inserted. Such cards are fed singly from the bottom of a stack and transported by belts and rollers to the place of insertion in the binder production line.

It is important that the cards be fed one by one to avoid what is generally referred to as a "double document" problem which runs risk of damage by reason of jamming of the transport and inserting mechanism, in addition to redundancy. Where a sucker cup is used to engage the bottom card of the stack it frequently happens, due to the inherent porosity of the card stock, that a vacuum is drawn through the bottom card and is applied between the surfaces of the lowermost cards in the stack so that two or more cards may be drawn downwardly at the same time. Such problem is obviously more acute where the cards are of thin stock, quite porous, and free of any coating.

Stripper type supports in the form of pointed needles arranged at an angle have been used in the past but have not been completely satisfactory or reliable since the weight of the stack on the tip portion of the needle results in high concentration of force so that the bottom card of the stack tends to be pinched between the stack and the needle wedging the bottom card tightly in place so that it resists dislodgement. Because of this phenomenon even a small degree of vacuum existing between the bottom card and the one above it tends to cause the feeding of two cards at a time.

It is an object of the invention in one of its aspects to provide a stripper type support in the form of a hollow pressurized needle having a beveled tip and on which the corner of the stack is supported by resting on the bevel and which therefore acts consistently upon all stacks and upon all cards in the stack as distinguished from the use of air injection nozzles in which the positioning with respect to the stack is variable and imprecise.

It is an object of the invention to provide, in a sheet for feeding cards from a stack one by one, a stripper type support for the lower corner of the stack which ensures quick and easy release of the bottom card when the latter is engaged and drawn downwardly by a sucker cup. It is a related object to provide a stripper type support for a card stack which ensures decisive separation between the bottom card and the one above it by the breaking of vacuum between the cards thereby ensuring the single feeding of the bottom card. It is a more general object to provide a stripper type support for a card stack which is capable of handling cards having a wide variation in the degree of porosity, thickness and stiffness and which therefore requires a minimum of adjustment of operating conditions when one type of card is replaced by another.

It is a more specific object to provide a stripper type support in the form of a hollow needle having a longitudinally extending discharge orifice which faces upwardly and which extends on both sides of the corner of the stack dividing the orifice into an upper portion and a lower portion with pressurized air from the upper portion being injected directly between the lowermost cards in the stack to break any vacuum between them and for the purpose of lubricating the bottom card with respect to the one above it so that the bottom card may be more easily withdrawn, by flicking action, past the point of the needle.

It is a related object to provide a stripper type support for a card stack in the form of a hollow needle which avoids wedging of the bottom card at the point of support and which therefore provides easy and reliable release of the bottom card even for large stack heights. It is, therefore, an object to provide an arrangement for feeding cards from a vertical stack which is capable of operating reliably without supervision and without necessity for frequent reloading during long binding runs.

It is still another object of the present invention to provide a stripper type support for a card stack in the form of a hollow pressurized needle which not only gives superior results, ensuring against "double document" feeding but which is highly economical using a commercially available form of needle obtainable at low cost and which is capable of operating at highest commercial feeding speeds for long periods of time without care or maintenance.

Other objects and advantages of the invention will become apparent upon reading the attached detailed description and upon reference to the drawings in which:

FIG. 1 is a side elevation of a card feeding device constructed in accordance with the present invention.

FIG. 1*a* is a perspective, at reduced scale, of the sucker block mechanism.

Figure 5:
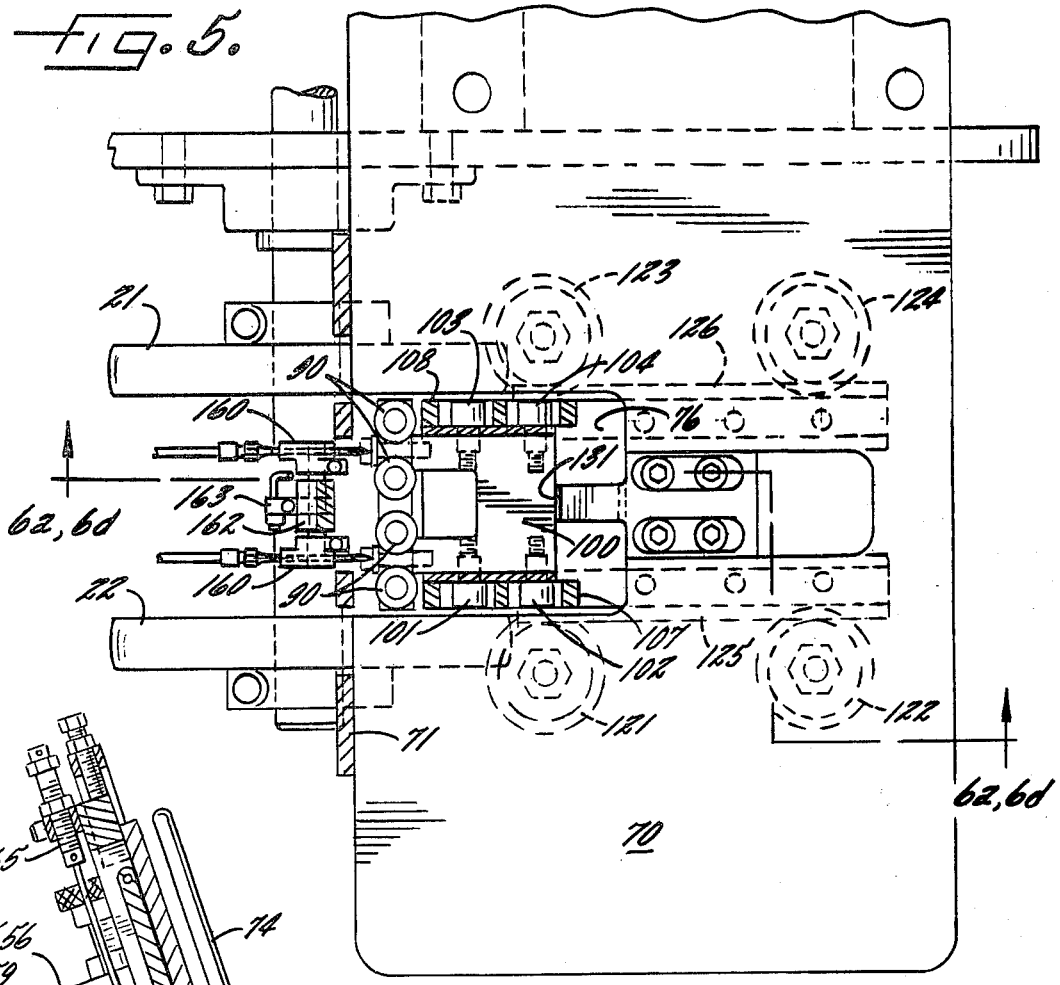
FIG. 5 is a top view in partial section looking along line 5—5 in FIG. 1.
Figure 6A:
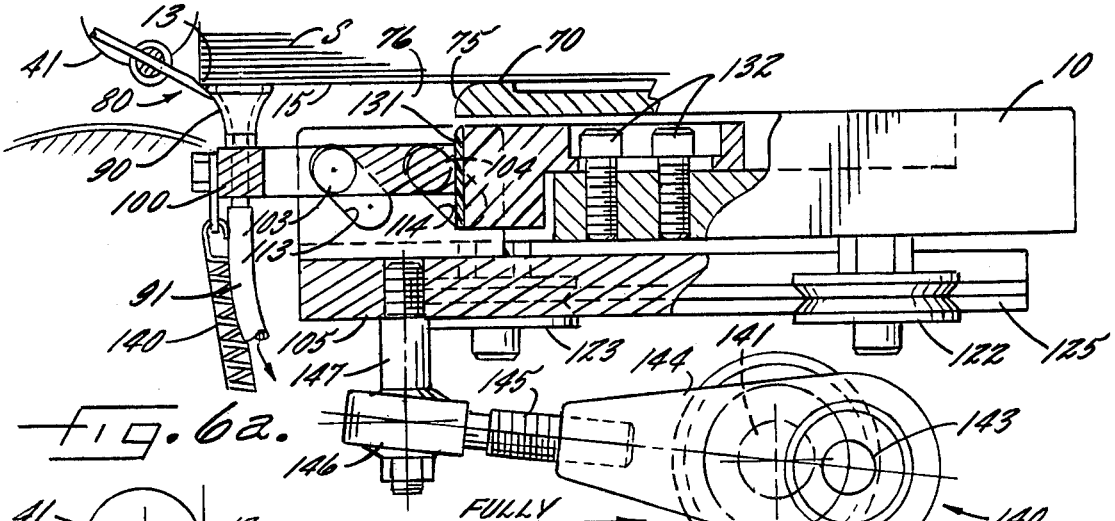

FIGS. 6*a*–6*d* are a series of stop motion views taken along line 6*a*–6*d* in FIG. 5, shown in the following:

FIG. 6*a* shows the pitman and sucker block retracted, with the sucker block in its elevated position.

Figure 6B:
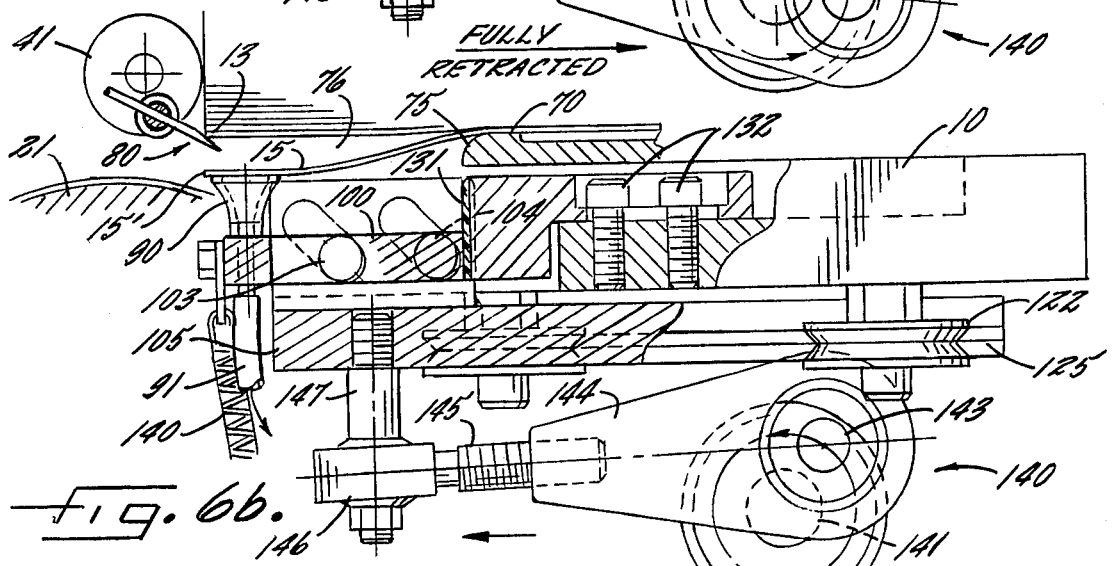

FIG. 6*b* shows the pitman partially advanced with the sucker block in lowered position with incipient separation at the striker.

Figure 6C:
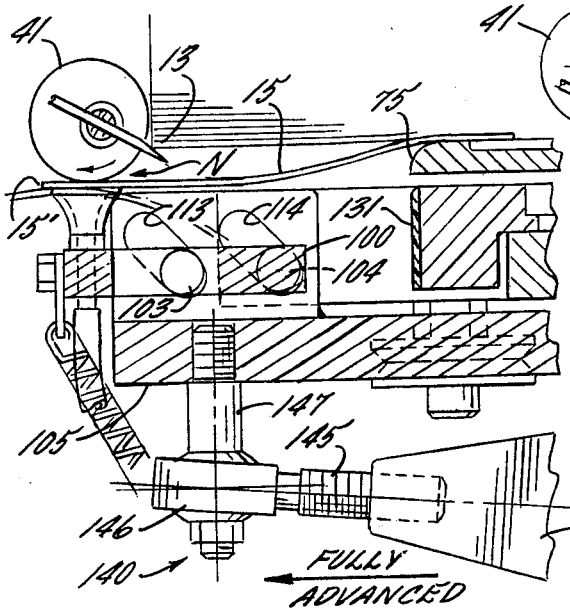

FIG. 6*c* shows the pitman fully advanced for feeding of the engaged card into the nip.

Figure 6D:
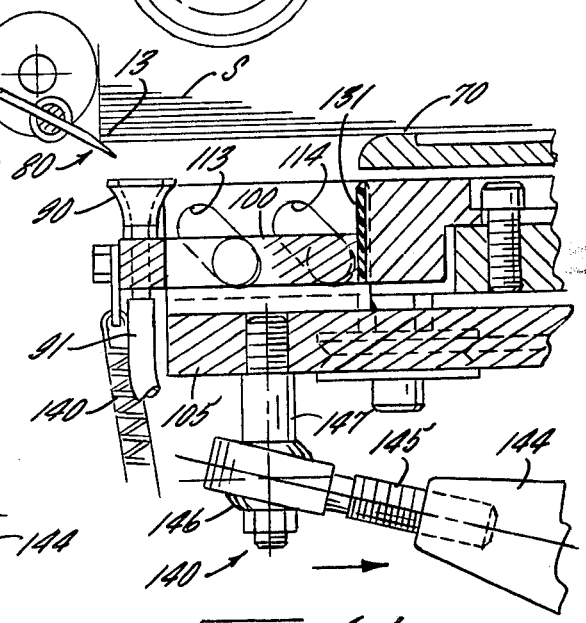

FIG. 6*d* shows the pitman partially retracted, with contact at the striker and with the sucker block about to be elevated.

Figure 7:
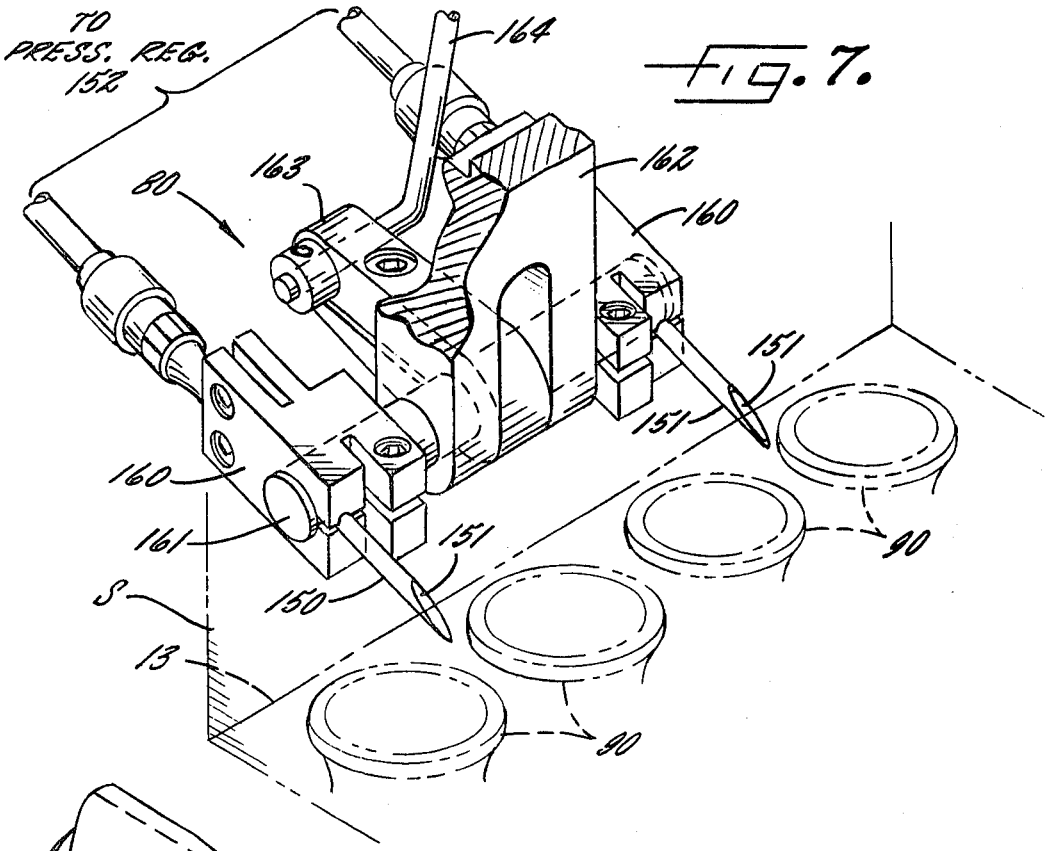

FIG. 7 is a fragmentary perspective showing the hollow needle supporting and angling structure.

Figure 8:
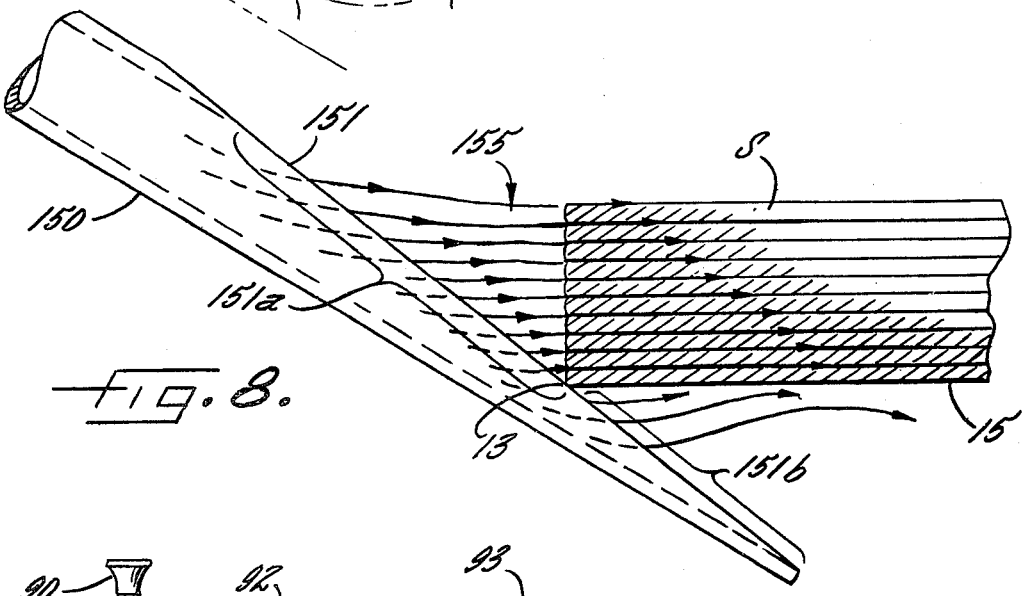

FIG. 8 is an enlarged fragment, in elevation, showing the tip of a needle in engagement with the front corner of the stack.

Figure 9:
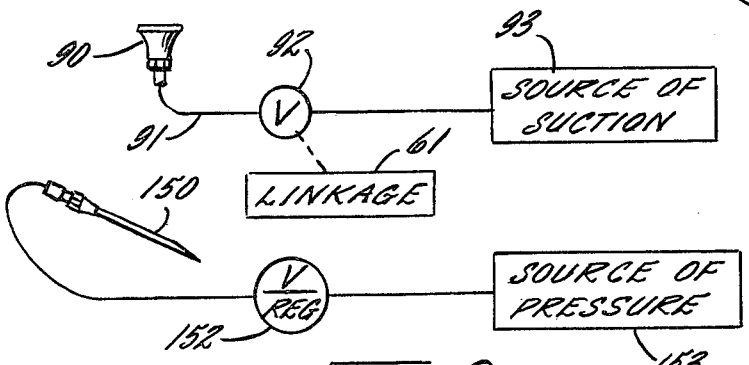

FIG. 9 is a schematic diagram of the vacuum and compressed air system.

While the invention has been described in connection with a preferred embodiment, it will be understood that there is no intention to limit the invention to the particular embodiment shown but it is intended, on the contrary, to cover the various alternative and equivalent constructions included within the spirit and scope of the appended claims.

Turning now to the drawings there is disclosed a machine for feeding cards one by one from the bottom of a vertical stack. Such machine has a frame 10 supporting a stack of cards S having leading edges 11 and trailing edges 12, the leading edges being in alignment with one another to form a lower corner 13 on the stack, with the bottom card of the stack being indicated at 15.

Figure 2:
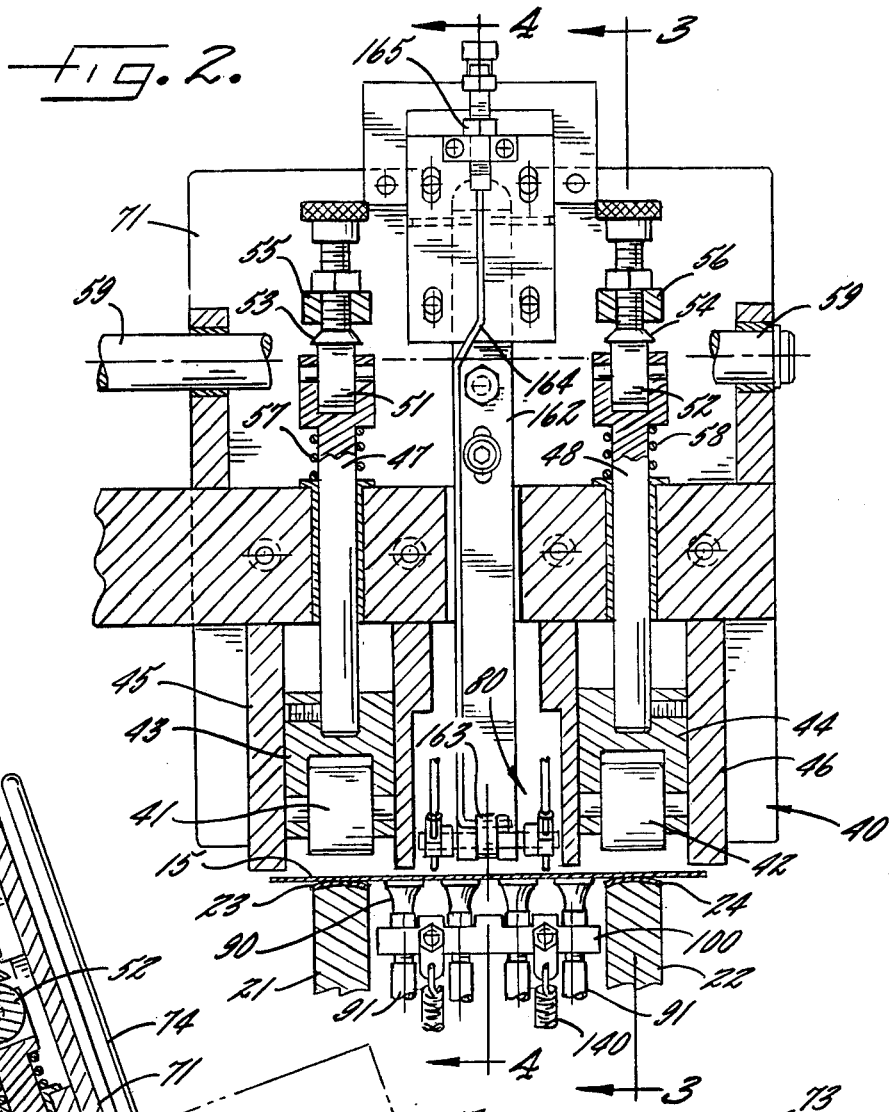
FIG. 2 is a vertical section looking along line 2—2 in FIG. 1.

Arranged in front of the stack is a transport system 20 having its inlet at a level slightly below the corner of the stack and including a pair of axially spaced narrow transport rollers 21, 22 encircled by belts 23, 24 (see also FIG. 2), respectively. The belts are trained about idler rollers 26, two of which are shown. In contact with the belts 23, 24 is a loop of belt 27, supported on idler rollers 28. The belts 23, 24 subsequently engage a mating transport belt 30 trained about rollers 31, 32. The belts are all formed as endless loops, with belts 27, 30 being of a width sufficient to span the pair of narrow belts 23, 24. The belts are driven in unison by any suitable means as, for example, a drive connection 34 from a drive motor 35.

Figures 1, 1A:
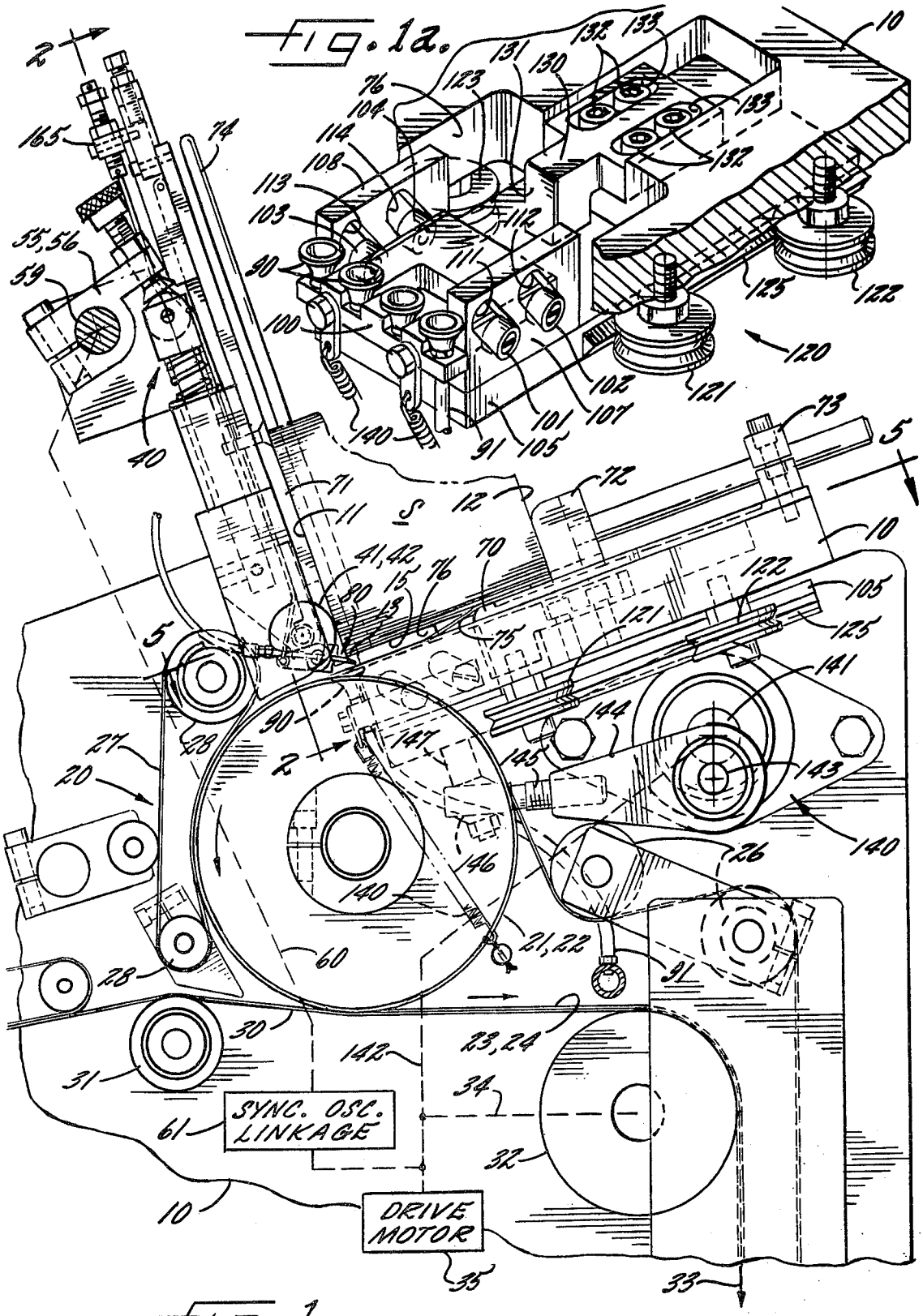

For engaging the leading edge of a card drawn from the stack S, a nip assembly 40 is provided which includes narrow nip rollers 41, 42 (see especially FIG. 2) which are respectively aligned with transport rollers 21, 22 having carriers 43, 44 mounted in vertical guideways 45, 46. The brackets are secured to plungers 47, 48 having cam followers 51, 52 at their upper ends respectively engaged by cams 53, 54. The cams are mounted upon arms 55, 56 which work against return springs 57, 58, the arms being mounted upon a rockable shaft 59 oscillated by a drive connection 60 (FIG. 1). The drive connection 60 includes a synchronized oscillating linkage 61 so that the nip rollers 41, 42 are thrust downwardly against the force of return springs 57, 58 into engagement with the belts on the transport rollers 21, 22 to form nips for receiving the present edge of the bottom card, as will be further described in connection with the stop motion views in FIGS. *6a–6d*.

Figure 3:
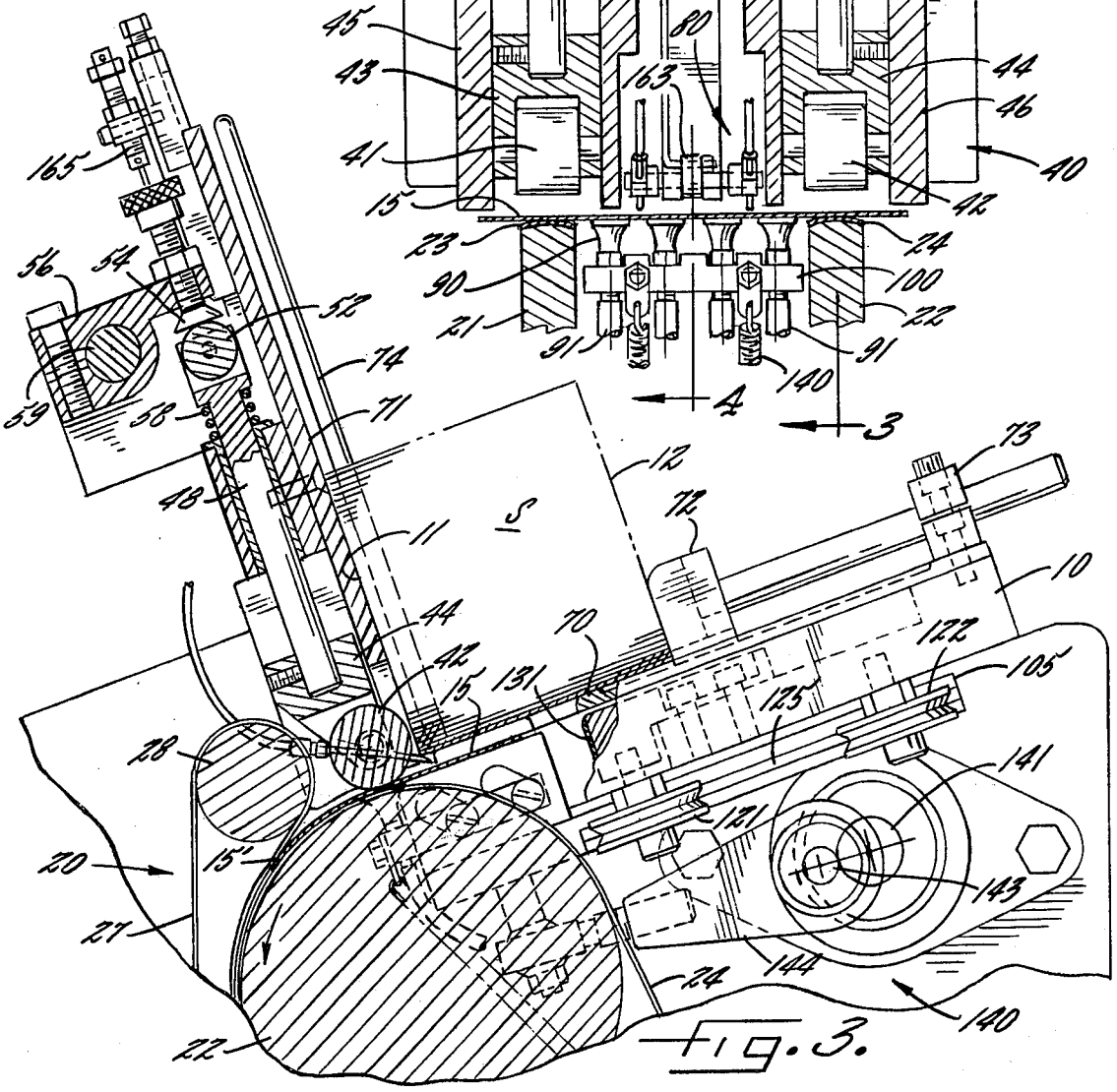
FIG. 3 is a vertical section taken along line 3—3 in FIG. 2.

Attention will next be given to the means for supporting the stack S. The main weight of the stack is borne by a platform 70 (FIGS. 1 and 3) which is under the trailing edge portion of the stack and thus in contact with the bottom card in the stack. At the front of the stack a vertical guide 71 is arranged at right angles to the platform for engaging the aligned leading edges 11. Opposite the vertical guide 71 is a rear guide 72 which is adjustably held in position by a clamp 73. The sides of the stack are engaged by vertical guide rods 74. The supporting platform 70 is foreshortened so that its front edge 75 defines an access window 76 at the leading edge portion of the stack. The lower, leading edge corner 13 of the stack is supported by a stripper type supporting assembly generally indicated at 80 which will subsequently be covered in detail. It will suffice at this point to say that the stripper type support is in the form of a pair of downwardly angled needles, the tips of which project a short distance under the leading edge portion of the stack so that when the bottom card is drawn downwardly, by sucker means to be described, the leading edge portion of the bottom card flicks past the needle projections thus stripping it from the stack.

In accordance with the present invention a set of suction cups face upwardly into the window 76 defined by the front edge 75 of the platform 70. The suction cups are supported on a sucker block which is supported by a sucker block carrier. Means are provided, in turn, for supporting the sucker block carrier on the frame of the machine for horizontal reciprocating movement in the forward and retract directions. A cam surface and cam follower are interposed between the sucker block and its carrier and a striker is provided on the frame fixedly arranged in the path of movement of the sucker block, the cam surface being so angled that when the carrier is retracted the sucker block engages the striker, blocking further movement of the sucker block in the retract direction but causing relative motion between the cam surface and cam follower in a direction to cam the sucker block upwardly for engagement of the suction cup with the underside of the bottom card, thereby completing an L-shaped path of movement for the suction cup. A biasing spring biases the sucker block downwardly with respect to the carrier so that in the subsequent forward stroke of the carrier the suction cups retrace their path moving downwardly until separation occurs at the striker and then forwardly. Suction is applied to the suction cups during their downward and forward movement so that the suckingly engaged bottom card flicks downwardly past the stripper type support at the front of the window, followed by outward feeding of the leading edge of the card into the receiving nip.

Thus, referring primarily to FIGS. 1 and 1*a*, a set of four suction cups 90 are provided facing upwardly into the window 76 and having respective suction lines 91 which are connected, via a valve 92 (FIG. 9) to a source of suction 93. The suction cups are supported upon a sucker block 100 having a pair of cam follower projections 101, 102 along one lateral edge and a similar pair of cam followers 103, 104 along the other. Arranged below the sucker block is a sucker block carrier 105 in the form of a plate having upstanding opposed walls 107, 108. The sucker block 100 is dimensioned to fit between the walls for free sliding movement. The walls have symmetrically angled slots 111, 112 and 113, 114, respectively, which define cam surfaces which receive the cam followers 101, 102 and 103, 104. The cam surfaces and cam followers provide freedom of vertical movement of the sucker block, and arranging such cams and cam followers in symmetrical pairs ensures that the sucker block, during the course of such vertical movement, will remain parallel to the carrier.

For the purpose of supporting the sucker block carrier on the frame for horizontal reciprocating movement in forward and retract directions, a mount 120 is provided made up of four grooved rollers, 121, 122 on one side and 123, 124 on the other side, journalled on the frame 10 and lying in a common plane. The sucker block carrier is sharpened along its lateral edges 125, 126 for engagement of the roller grooves for substantially frictionless reciprocating movement with respect to the frame.

In accordance with one of the important features of the present invention, a striker is arranged on the frame fixed in the path of horizontal movement of the sucker block as the sucker block is moved by the carrier in the retract direction. The cam surfaces 111–114 are so angled that when the carrier 105 is retracted, the sucker block 100, during the course of such retracting movement, engages the striker thereby blocking further movement of the sucker block in the retract direction but causing relative motion between the cam surfaces and cam followers in a direction to cam the sucker block upwardly via the access window 76 for engagement of the suction cups with the underside of the bottom card, thereby completing an L-shaped path of movement for the suction cups. The striker, indicated at 130, has a striking, or blocking, surface 131 and is secured to the frame 10 of the machine by a set of bolts 132 which penetrate longitudinal clearance slots 133 formed therein. A set of biasing springs 140 are provided for biasing the sucker block 100 downwardly with respect to the carrier so that in the subsequent forward stroke of the carrier the suction cups retract their path of movement, moving downwardly until separation occurs at the striker and then forwardly so that the suckingly engaged bottom card, indicated at 15, flicks downwardly past the projections 80, thereby stripping the card from the stack followed by outward feeding of the leading edge of the card into the receiving nip.

Further in accordance with the invention, means including a crank and pitman are provided for reciprocating the sucker block carrier in the forward and retract directions. The crank and pitman assembly indicated generally at 140 (FIG. 1) includes a crankshaft 141 having a connection 142 to the drive motor 35. Eccentrically positioned on the shaft in a crank 143 which engages a pitman 144 having an adjustable leg 145 which is connected via a ball and socket connection 146 to a post 147 extending downwardly from the carrier.

The operation of the mechanism thus far described will be apparent upon considering the stop motion views *6a–6d* inclusive. In FIG. *6a* the carrier 105 is shown fully retracted with the sucker block 100 in engagement with the striking surface 131 on the striker 130, which engagement has caused the sucker block to ride upwardly on the cam surfaces 113, 114 against the force of the biasing springs 140. As a result the sucker 100 occupies its elevated position, with the suction cups 90 in contact with the leading edge portion of the bottom card 15. The valve 92 is coupled to the linkage 61 (FIG. 9) or, alternatively, to the shaft 141, so that the suction is turned on at least during the forward stroke of the pitman.

As the crankshaft 141 rotates in the counterclockwise direction the pitman 144 thrusts the carrier 105 forwardly, causing the cam surfaces 111–114 to move forwardly relative to the cam followers 101–104 on the sucker block. This permits the springs 140 to draw the sucker block 100 downwardly into the position illustrated in FIG. *6b*. The resultant lowering of the suction cups 90, which suckingly engage the bottom card 15, causes the leading edge 15' of the bottom card to flick downwardly past the tips of the needle projections 80, thereby stripping the bottom card from the stack.

Continued forward movement of the pitman 144 results in separation of the sucker block 100 from the striking surface 131 of the striker, followed by forward movement of the sucker block in unison with the carrier until the carrier reaches the fully advanced position illustrated in FIG. *6c*. Simultaneously, the nip rollers 41, 42, which initially occupy an upraised position as illustrated in FIGS. *6a* and *6b*, are lowered by the linkage 61, which is synchronously connected to the drive motor 35, so that the rollers 41, 42 engage the transport rollers 21, 22 to form a nip N which grippingly receives the leading edge portion of the card 15 as the card is advanced forwardly by the suction cups. As already indicated, the lowering of the nip rollers 41, 42 comes about by the rocking movement of the shaft 59 which rocks the arms 55, 56 down against the plungers 47, 48 against the restoring force of the coil springs 57, 58.

As soon as the leading edge of the card has been grasped in the nip, the suction is turned off by the valve 92 so that the card is pulled from under the stack and off of the supporting platform 70 into the path of transport. In the path of transport the card is first engaged between the pair of belts 23, 24 and the cooperating belt 27. When the card leaves the belt 27 it continues to be transported between the belts 23, 24 and the belt 30, being discharged along the path 33.

With the suction cups now free, the carrier 105, and with it the sucker block 100, move in the retract direction as indicated by the arrow in FIG. *6d* until the sucker block engages the striking surface 131. This prevents the sucker block 100 from being retracted any further by the carrier; in other words, the sucker block is blocked in its horizontal movement. Thus, as the pitman 144 continues to retract the carrier, relative motion between the cam surfaces 111–114 and the cam followers 101–104 causes the sucker block 100 to be cammed upwardly against the force of the springs 140 until the suction cups 90 again occupy the starting position illustrated in FIG. *6a*. The nip rollers 41, 42 are, during the retracting movement of the pitman 144, permitted by the oscillating linkage 61 to be moved by the coil springs 57, 58 back to the upraised position illustrated in FIG. *6a*.

The cycle is endlessly repeated at a high repetitive rate which may, in a practical case, approach 300 cards per minute. Notwithstanding the impact with the striker 130 which occurs during each feeding cycle, experience has shown that the operation occurs smoothly with a minimum of noise and vibration. Preferably, the striking surface 131 is padded with a layer of cushioning material having a low coefficient of friction as, for example, Teflon. To bring about a still further reduction in the energy of impact, the sucker block 100 may be formed of a lightweight plastic material and, if desired, the striker 130 itself may be formed of a material having sound and vibration deadening characteristics.

In accordance with one of the features of the present invention, means are provided for adjusting the point in the path of retracting movement of the sucker block in which the sucker block engages the striker. More specifically, the striker 130 is relatively adjustable in horizontal position with respect to the frame to vary the point in the path of retracting movement of the sucker block at which striking occurs thereby to adjust the upper limit position reached by the suction cups 90. In short, the earlier in the path of retracting movement that striking occurs, the higher will be the maximum elevation of the suction cups. Adjustment of the striker 130 thereby serves as a convenient way of optimizing contact between the suction cups 90 in the lowermost card. The adjustment is not, however, critical provided that the suction cups are made of rubber or similar yieldable material.

Moreover, screwing in or out of the adjustable leg 145 of the pitman determines the forward limit position of the card and, consequently, the degree to which the leading edge of the card is inserted into the nip N at the end of the forward stroke.

In accordance with one of the important aspects of the present invention the stripper type support at the front corner of the stack is in the form of one or more needles having a downwardly angled tip portion extending inwardly and downwardly with repsect to the window by a shallow amount so that the leading edge of the bottom card rests against the tip portion of the needle, the needle being of hollow construction and fed a source of pressurized air. The tip portion of each needle has a longitudinally extending discharge orifice which faces upwardly and which extends both above and below the corner of the stack, dividing the orifice into an upper portion and a lower portion. The air which is fed to the needle is at a sufficiently high pressure so that air from the upper portion of the orifice is forced between the lowermost cards in the region above the suction cups thereby breaking any suction which may exist between the cards and serving as a lubricant for the bottom card facilitating its prompt release from the stack upon downward movement of the suction cups.

Thus, referring to FIGS. 7 and 8 the stripper type supporting assembly 80 includes a pair of hollow needles 150. The tips of the needles have longitudinally extending discharge orifices 151. The orifices are preferably formed by beveling the needles at a shallow angle. The needles are so positioned with respect to the stack that the corner 13 of the stack is engaged approximately midway along the orifices 151, dividing each orifice into an upper portion 151*a* and a lower portion 151*b* (see FIG. 8) Compressed air is fed to the needles 150 through a pressure regulator 152 (FIG. 9) which is connected to a source of pressure 153. In practice, the needles 150 may be approximately 1/16th inch in inner diameter cut on an angle of about 5° to about 15°, preferably 7°, and producing an orifice which has a slant length on the order of 3/8". The pressure furnished to the needles may be within the range of 3 lbs. per square inch to 50 lbs. per square inch, as set by the pressure regulator.

As illustrated in FIG. 8, the compressed air, indicated at 155 and which exits at the upper portion 151*a* of the orifice, is travelling at a sufficient velocity as to force its way between the adjacent cards, particularly the bottom card and the one above it.

As is well known, the cards normally included with a periodical are often made of porous relatively inexpensive stock. Because of the porosity, the application of suction by the cups 90 to the bottom card results in suction being created between the bottom card and the second, and sometimes even third and fourth cards in the stack. Thus, when the suction cups are drawn downwardly, they tend to take along not only the bottom card but the second card as well, by reason of the suction between the cards. This problem, referred to as "double document" feeding, is accentuated by the fact that, where the cards are in a stack of substantial height, the weight of the stack on the tip portion of the needle results in high concentration of force at the point of support, so that the bottom card of the stack tends to be "pinched" between the stack and the needle, wedging the bottom card so tightly in place that it resists dislodgement. This requires that relatively high levels of vacuum must be used for reliable draw-down of the bottom card, increasing the likelihood that suction will exist between the bottom card and the one next to it, particularly where the cards are of thin porous stock and free of any surface coating.

By the use of hollow pressurized needles as a stripper type support for the leading edge corner of the stack reliable "single document" feeding is assured regardless of the porosity or other characteristics of the card stock. Moreover, the compressed air which is forced between the adjacent cards serves as an effective lubricant so that the bottom card is more easily removed regardless of its "pinched" condition.

Figure 4:
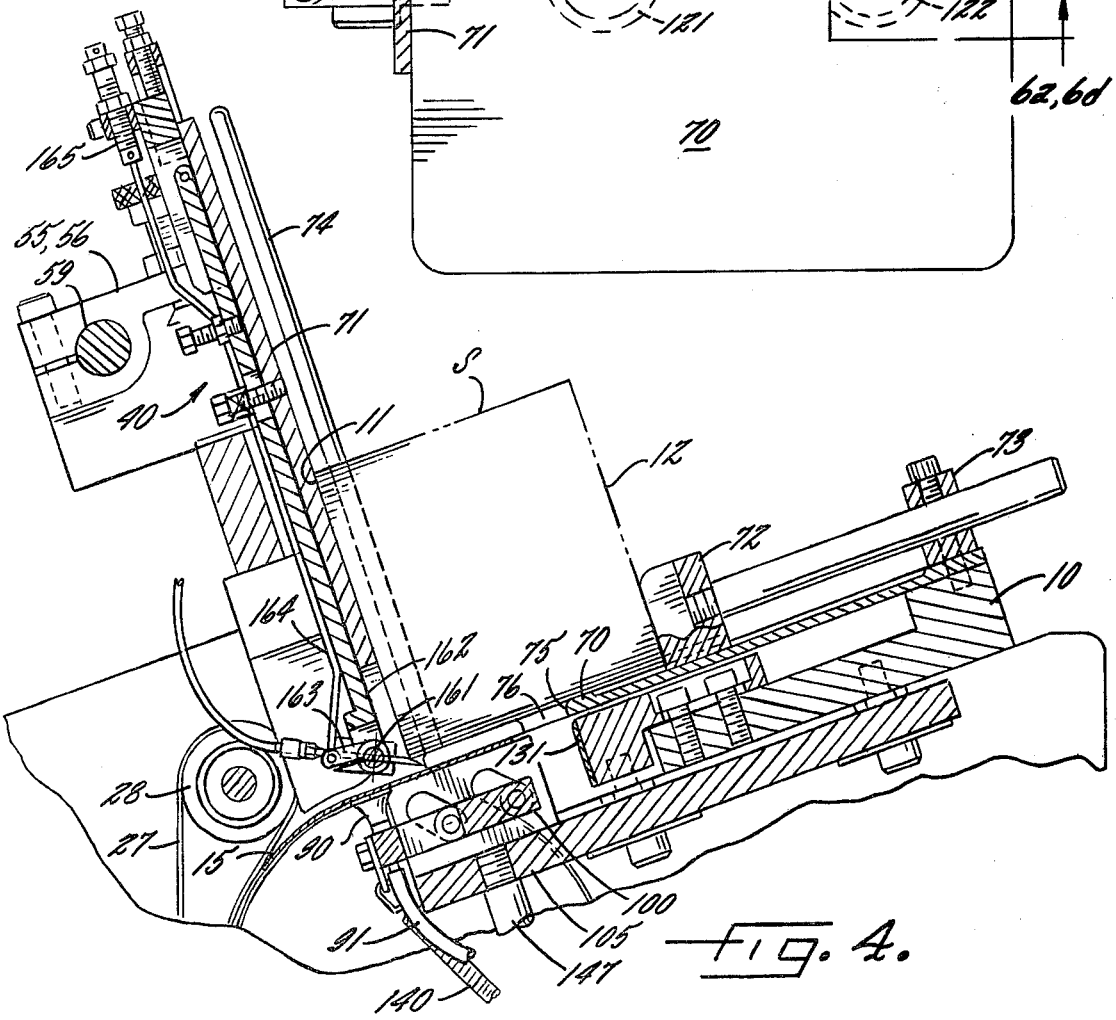
FIG. 4 is a displaced vertical section taken along line 4—4 in FIG. 2.

In accordance with one of the aspects of the present invention, means are provided for varying the downward angling of the needle with respect to the plane of the bottom card. This is accomplished, as shown in FIGS. 4 and 7, by mounting each needle in a rocking support, or chuck, 160 which is mounted upon a shaft 161 journalled in a bracket 162. Rigidly clamped to the center of the shaft is an actuating arm 163 to which is coupled a vertical pushrod 164, at the upper end of which is an adjuster 165. The optimum angle between the needle axis and the plant of the bottom card is preferably on the order of 28°. By use of the above described adjusting mechanism such angle may be varied between about 10° and about 45°. The needles 150 are preferably spaced from one another at such a distance as to be interspersed between the suction cups 90, as illustrated in FIG. 7. By interspersing the needles between the suction cups a minimum of downward movement of the cups is required to flick the leading edge of the card into its free, stripped condition.

While the invention has been described in connection with a pair of needles supporting the leading edge portion of the stack, it will be apparent to one skilled in the art that, if desired, a single needle might be relied upon or, alternatively, three or even four needles, operating in parallel, might be used.

By using movable nipping rollers the amount of movement into the nip brought about, as stated, by adjustment of the length of the pitman, is noncritical and may even be excessive, with overtravel of the card in the forward direction, without any obstruction or tendency toward buckling.

Generally stated, single card feeding and transport at high speed achieved by the mechanism described above is highly reliable and adjustments are simple and noncritical and, once made, are preserved for long periods of time regardless of the characteristics of the paper stock being employed and regardless in variations in the dimensions of the card.

To keep the stack of cards in accurate and constant alignment with the front guide 71, thereby to keep the lower, leading corner 13 of the stack at a reference position with respect to the orifices in the hollow needles, the entire machine is "rocked" forwardly through a small angle with respect to the vertical, as set forth, for example, in FIG. 1. Accordingly, the terms "vertical" and "horizontal" will be understood to be relative terms related to the height dimension of the stack.

I claim:

1. A machine for feeding cards from a vertical stack having a leading edge portion and a trailing edge portion, the cards in the stack having their leading edges in alignment with one another to form a lower corner on the stack comprising, in combination, a frame, a platform on the frame positioned to support the trailing edge portion of the stack and in contact with the bottom card in the stack, a vertical guide at right angles to the platform for engaging the aligned leading edges of the cards in the stack, the edge of the platform being horizontally spaced from the vertical guide to define a downwardly facing access window under the leading edge portion of the stack, a stripper type support for the leading edge corner portion of the stack in the form of a needle having a downwardly angled tip portion extending inwardly and downwardly with respect to the window by a shallow amount under the corner of the stack so that the leading edge of the bottom card rests against the tip portion of the needle, a suction cup facing upwardly into the window, a source of suction connected to the suction cup, means mounting the suction cup for vertical movement between an upper position in which the sucker cup is in engagement with the bottom card of the stack and a downwardly retracted position which is below the tip portion of the needle so that the leading edge of the bottom card flicks past the tip of the needle as the card is drawn downwardly, drive means for cycling the suction cup between its upper position and its downwardly retracted position, the source of suction having control means synchronized with the drive means so that the suction is effective in the upper position of the cup and during the course of downward movement, the needle being of hollow construction and having a source of pressurized air, the tip portion of the needle having a longitudinally extending discharge orifice which faces upwardly and which extends both above and below the corner of the stack dividing the orifice into an upper portion and a lower portion, the source of air being at a sufficiently high pressure so that air from the upper portion of the orifice is forced between the lowermost cards in the region above the suction cup thereby breaking any suction which may exist between the cards and serving as a lubricant for the bottom card facilitating its prompt release from the stack upon downward movement of the suction cup, and means for subsequently gripping the bottom card for drawing the card clear of the platform and for transporting the card from its downwardly retracted position.

2. A machine for feeding cards from a vertical stack having a leading edge portion and a trailing edge portion, the cards in the stack having their leading edges in alignment with one another to form a lower corner on the stack, comprising, in combination, a frame, a platform on the frame positioned to support the trailing edge portion of the stack and in contact with the bottom card in the stack, the edge of the platform being horizontally spaced from the corner of the stack to define a downwardly facing access window under the leading edge portion of the stack, a stripper type support for the leading edge portion of the stack in the form of a needle having a downwardly angled tip portion extending inwardly below the window by a shallow amount so that the edge of the bottom card rests against the tip portion of the needle, a suction cup facing upwardly into the window, a source of suction connected to the suction cup, means mounting the suction cup for vertical movement between an upper position in which the sucker cup is in engagement with the bottom card of the stack and a downwardly retracted position which is below the tip portion of the needle so that the leading edge portion of the bottom card flicks past the tip of the needle as the card is drawn downwardly, drive means for cycling the suction cup between its upper position and its downwardly retracted position, the source of suction having control means so that the suction is effective in the upper position of the cup and during the course of downward movement, the needle being of hollow construction and having a source of pressurized air, the tip portion of the needle having a longitudinally extending discharge orifice which faces upwardly and which extends both above and below the bottom card dividing the orifice into an upper portion and a lower portion, the source of air being at a sufficiently high pressure so that air from the upper portion of the orifice is forced between the lowermost cards in the region above the suction cup thereby breaking any suction which may exist between such cards and serving as a lubricant for the bottom card facilitating its prompt release from the stack upon downward movement of the suction cup.

3. The combination as claimed in claim 1 or in claim 2 in which the tip portion of the needle is downwardly angled at an angle from the horizontal in the direction of the stack, the range of angle being from about 10° to about 45°.

4. The combination as claimed in claim 1 or in claim 2 in which the discharge orifice at the tip portion of the needle is formed by a bevel cut at a shallow angle with respect to the needle axis.

5. The combination as claimed in claim 1 or in claim 2 in which the discharge orifice at the tip portion of the needle is formed by a bevel cut at an angle ranging from about 5 to about 15 degrees with respect to the needle axis.

6. The combination as claimed in claim 1 in which a plurality of such needles are provided spaced laterally from one another.

7. The combination as claimed in claim 5 in which a plurality of suction cups are provided spaced laterally from one another with the needles being interspersed with the suction cups.

8. The combination as claimed in claim 1 or in claim 2 in which the needle is downwardly angled at an angle on the order of 28° in which the tip portion of the needle is beveled at an angle on the order of 7° with respect to the needle axis, in which the needle has an inner diameter of approximately 1/16 inch, and in which the needle is connected to a source of pressurized air having a pressure within the range of 3 psi and 50 psi.

* * * * *